US007462988B2

(12) United States Patent
Kim

(10) Patent No.: US 7,462,988 B2
(45) Date of Patent: Dec. 9, 2008

(54) PLASMA DISPLAY PANEL HAVING A LAYER INCLUDING CARBON

(75) Inventor: Chul-Hong Kim, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 0 days.

(21) Appl. No.: 11/512,650

(22) Filed: Aug. 29, 2006

(65) Prior Publication Data

US 2007/0057636 A1 Mar. 15, 2007

(30) Foreign Application Priority Data

Sep. 12, 2005 (KR) ..... 10-2005-0084652

(51) Int. Cl.
*H01J 17/49* (2006.01)

(52) U.S. Cl. ..... 313/585; 313/586; 313/587

(58) Field of Classification Search ..... 313/582–587
See application file for complete search history.

(56) References Cited

U.S. PATENT DOCUMENTS

| | | | | |
|---|---|---|---|---|
| 6,657,396 | B2 * | 12/2003 | Nakada et al. | 315/169.1 |
| 6,933,674 | B2 * | 8/2005 | Im et al. | 313/582 |
| 7,122,962 | B2 * | 10/2006 | Law et al. | 313/586 |
| 2001/0024084 | A1 * | 9/2001 | Kajiwara | 313/486 |
| 2002/0084751 | A1 * | 7/2002 | Kim | 313/582 |
| 2003/0193291 | A1 * | 10/2003 | Im et al. | 313/582 |
| 2003/0218424 | A1 * | 11/2003 | Law et al. | 313/587 |
| 2004/0080270 | A1 * | 4/2004 | Fujitani et al. | 313/582 |
| 2004/0124773 | A1 * | 7/2004 | Mun et al. | 313/584 |
| 2004/0263039 | A1 * | 12/2004 | Takei et al. | 313/110 |
| 2005/0007017 | A1 * | 1/2005 | Kim et al. | 313/582 |
| 2005/0087363 | A1 | 4/2005 | Tsukahara et al. | |

(Continued)

FOREIGN PATENT DOCUMENTS

EP 1 353 355 A1 10/2003

(Continued)

OTHER PUBLICATIONS

Shelby, J.E., et al.; "Colloidal Silver Formation at the Surface of Float Glass"; Journal of Non-Crystalline Solids 50; 1982; 107-117; North-Holland Publishing Company.

(Continued)

*Primary Examiner*—Joseph L. Williams
*Assistant Examiner*—Bumsuk Won
(74) *Attorney, Agent, or Firm*—Christie, Parker & Hale, LLP

(57) ABSTRACT

A plasma display includes a first substrate and a second substrate disposed substantially in parallel and spaced apart from one another; address electrodes formed on the first substrate; a first dielectric layer formed on a surface of the first substrate and covering the address electrodes; barrier ribs disposed between the first substrate and the second substrate to form compartmentalized discharge cells; phosphor layers formed in the discharge cells; display electrodes comprising a bus electrode disposed on one side of the second substrate opposing the first substrate in a direction crossing the address electrodes; a second dielectric layer formed on a surface of the second substrate and covering the display electrodes; and a protection layer covering the second dielectric layer. At least one electrode, dielectric layer, or carbon layer between an electrode and a neighboring member includes carbon.

16 Claims, 9 Drawing Sheets

U.S. PATENT DOCUMENTS

| | | | | |
|---|---|---|---|---|
| 2005/0099126 | A1* | 5/2005 | Kim et al. | 313/586 |
| 2005/0212430 | A1* | 9/2005 | Ahn et al. | 313/587 |
| 2005/0264209 | A1* | 12/2005 | Park et al. | 313/586 |

FOREIGN PATENT DOCUMENTS

| | | | |
|---|---|---|---|
| EP | 1 367 621 | A1 | 12/2003 |
| KR | 1999-0058458 | | 7/1999 |
| KR | 10-2001-0039031 | | 5/2001 |
| KR | 2002-0055807 | | 7/2002 |
| KR | 10-2005-0082363 | | 8/2005 |

OTHER PUBLICATIONS

Korean Patent Abstracts, Publication No. 10-1999-0058458, dated Jul. 15, 1999, in the name of Seung-Jun Mun et al.

Korean Patent Abstracts, Publication No. 1020010039031 A, dated May 15, 2001, in the name of Yeong Guk Kwon.

Korean Patent Abstracts, Publication No. 1020050082363 A, dated Aug. 23, 2005, in the name of Byung Gil Ryu.

Korean Patent Abstracts, Publication No. 1020020055807 A, dated Jul. 10, 2002, in the name of Jae Seong Kim.

Extended European Search Report for corresponding European Application No. 06119020.3, dated Jun. 6, 2008, indicated relevance of the listed references in this IDS.

* cited by examiner

PLASMA DISPLAY PANEL HAVING A LAYER INCLUDING CARBON

CROSS-REFERENCE TO RELATED APPLICATION

This application claims priority to and the benefit of Korean Patent Application No. 10-2005-0084652 filed in the Korean Intellectual Property Office on Sep. 12, 2005, the entire content of which is incorporated herein by reference.

FIELD OF THE INVENTION

The present invention relates to a plasma display panel, and more particularly to a plasma display panel that includes an electrode or another member including carbon therein or a carbon layer adjacent thereto to inhibit an electrode color-change by corrosion, a short between the electrodes, and yellowing of a glass substrate.

BACKGROUND OF THE INVENTION

Display electrodes and address electrodes of a plasma display panel (PDP) usually include silver having high electroconductivity.

The silver electrode can be made in accordance with various methods. It is generally made by the following process: a paste including silver particles, glass frit, a resin, and a solvent is screen-printed to form a pattern, which is then fired at at least 500° C.

The silver electrode may be ionized to $Ag^+$ during the firing process, and the ions may migrate to an adjacent glass substrate or a dielectric layer through diffusion. Diffused silver ions are reduced by alkali metals such as $Sn^{2+}$, $Na^+$, or $Pb^{2+}$ in the glass substrate or dielectric layer. The reduced silver ions are precipitated as colloid particles and grown continuously, resulting in coloring of the glass substrate or dielectric layer. This phenomenon causes yellowing of a PDP panel (J. E. SHELBY and J. VITKO. Jr Journal of Non Crystalline Solids Vo1. 50 1982 107-117).

Such a yellowing phenomenon has an unfavorable effect on display quality of a module, such as on the contrast ratio in a bright room, resulting in deterioration of brightness and chromaticity of a panel. Resultantly, the above phenomena significantly deteriorate the display quality of a PDP.

Furthermore, the silver electrode becomes silver oxide or silver sulfide from external factors such as moisture or impurities. The silver oxide or silver sulfide may be deposited on the electrode surface and cause a poor electrode pattern. In addition, the color of the silver electrode may be changed and it may corrode, resulting in deterioration of life-span as well as electrical characteristics.

There are many approaches to solve the problems, but the problems of corrosion of a silver electrode and yellowing of a glass substrate and a dielectric layer persist.

SUMMARY OF THE INVENTION

An embodiment of a plasma display panel includes a first substrate and a second substrate disposed substantially in parallel and spaced apart from one another; address electrodes formed on the first substrate; a first dielectric layer formed on a surface of the first substrate and covering the address electrodes; barrier ribs disposed between the first substrate and the second substrate to form compartmentalized discharge cells at predetermined intervals; phosphor layers formed in the discharge cells; display electrodes including a bus electrode disposed on one side of the second substrate opposing the first substrate in a direction crossing the address electrodes; a second dielectric layer formed on a surface of the second substrate and covering the display electrodes; and a protection layer covering the second dielectric layer. At least one electrode selected from the address electrodes and the bus electrodes includes carbon.

Another embodiment of a plasma display panel includes a first substrate and a second substrate disposed substantially in parallel and spaced apart from one another; address electrodes formed on the first substrate; a first dielectric layer formed on a surface of the first substrate and covering the address electrodes; barrier ribs disposed between the first substrate and the second substrate to form compartmentalized discharge cells at predetermined intervals; phosphor layers formed in the discharge cells; display electrodes disposed on one side of the second substrate opposing the first substrate in a direction crossing the address electrodes; a second dielectric layer formed on a surface of the second substrate and covering the display electrodes; and a protection layer covering the second dielectric layer. At least one dielectric layer selected from the dielectric layer on the first substrate and the second dielectric layer on the second substrate includes carbon.

Another embodiment of a plasma display panel includes a first substrate and a second substrate disposed substantially in parallel and spaced apart from one another; address electrodes formed on the first substrate; a first dielectric layer formed on a surface of the first substrate and covering the address electrodes; barrier ribs disposed between the first substrate and the second substrate to form compartmentalized discharge cells; phosphor layers formed in the discharge cells; display electrodes disposed on one side of the second substrate opposing the first substrate in a direction crossing the address electrodes; a second dielectric layer formed on a surface of the second substrate and covering the display electrodes; a protection layer covering the second dielectric layer; and at least one carbon layer between at least one electrode, selected from the address electrodes and the display electrodes, and a member neighboring the at least one electrode.

The at least one electrode may include the carbon in an amount ranging from 0.1 to 10.0 parts by weight based on 100 parts by weight of a metal material. The metal material may be selected from the group consisting of silver (Ag), gold (Au), aluminum (Al), copper (Cu), platinum (Pt), rhodium (Rh), chromium (Cr), a platinum-rhodium alloy (Pt—Rh), a silver-palladium alloy (Ag—Pd), and combinations thereof.

The at least one dielectric layer may include the carbon in an amount ranging from 0.1 to 10.0 parts by weight based on 100 parts by weight of a metal oxide. The metal oxide may be a Pb-free glass powder selected from the group consisting of ZnO, B2O3, Al2O3, SiO2, SnO, P2O5, Sb2O3, Bi2O3, and combinations thereof.

The carbon in the at least one electrode, dielectric layer, or carbon layer may be selected from the group consisting of carbon black, graphite, acetylene black, SUPER P™, ketjen black, denka black, activated carbon powder, fullerene, carbon nanotube, carbon nanofiber, carbon nanowire, carbon nano-horn, carbon nanoring, and combinations thereof. The carbon in the at least one electrode or dielectric layer may have an average particle diameter ranging from 10 nm to 10 μm, and may have an average particle diameter ranging from 0.1 μm to 5.0 μm in the at least one carbon layer.

The at least one carbon layer may be disposed at at least one location selected from between the address electrodes and the first dielectric layer, between the address electrodes and the second substrate, and between the second substrate and the second dielectric layer. In one embodiment, the at least one carbon layer has a pattern corresponding to a pattern of the at least one electrode.

One embodiment of a method of manufacturing a plasma display panel includes providing a first substrate and a second substrate disposed substantially in parallel and spaced apart from one another; providing address electrodes on the first substrate; providing a first dielectric layer on an entire surface of the first substrate and covering the address electrodes; providing barrier ribs disposed between the first substrate and the second substrate to form compartmentalized discharge cells; providing phosphor layers in the discharge cells; providing display electrodes including a bus electrode disposed on one side of the second substrate opposing the first substrate in a direction crossing the address electrodes; providing a second dielectric layer on a surface of the second substrate and covering the display electrodes; and providing a protection layer covering the second dielectric layer. At least one electrode selected from the address electrodes and the bus electrodes includes carbon, and the at least one electrode is prepared by a method selected from the group consisting of screen printing, lift-off, photolithography, evaporation, sputtering, ion-plating, chemical vapor deposition (CVD), plasma enhanced chemical vapor deposition (PECVD), and combinations thereof.

Another embodiment of a method of manufacturing a plasma display panel, includes providing a first substrate and a second substrate disposed substantially in parallel and spaced apart from one another; providing address electrodes on the first substrate; providing a first dielectric layer on an entire surface of the first substrate and covering the address electrodes; providing barrier ribs disposed between the first substrate and the second substrate to form compartmentalized discharge cells; providing phosphor layers in the discharge cells; providing display electrodes disposed on one side of the second substrate opposing the first substrate in a direction crossing the address electrodes; providing a second dielectric layer on a surface of the second substrate and covering the display electrodes; and providing a protection layer covering the second dielectric layer. At least one dielectric layer selected from the dielectric layer on the first substrate and the second dielectric layer on the second substrate includes carbon and the at least one dielectric layer is formed by a method selected from the group consisting of screen printing, a dry film method, and combinations thereof.

Another embodiment of a method of manufacturing a plasma display panel, includes providing a first substrate and a second substrate disposed substantially in parallel and spaced apart from one another; providing address electrodes on the first substrate; providing a first dielectric layer on an entire surface of the first substrate and covering the address electrodes; providing barrier ribs disposed between the first substrate and the second substrate to form compartmentalized discharge cells; providing phosphor layers in the discharge cells; providing display electrodes on one side of the second substrate opposing the first substrate in a direction crossing the address electrodes; providing a second dielectric layer on a surface of the second substrate and covering the display electrodes; providing a protection layer covering the second dielectric layer; and providing at least one carbon layer between at least one electrode, selected from the address electrodes and the display electrodes, and a member neighboring the at least one electrode. The at least one carbon layer is formed by a method selected from the group consisting of screen printing, lift-off, photolithography, evaporation, sputtering, ion-plating, chemical vapor deposition (CVD), plasma enhanced chemical vapor deposition (PECVD), and combinations thereof.

DETAILED DESCRIPTION

Figure 1:
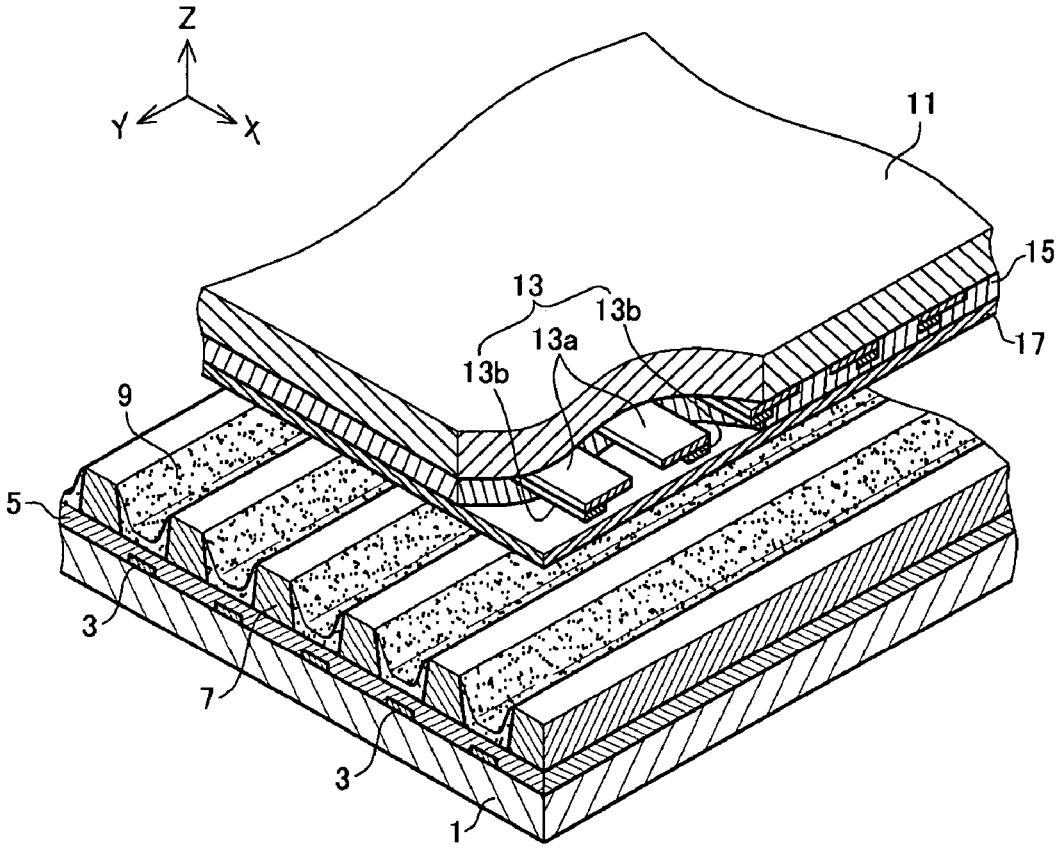
FIG. 1 is a schematic partially exploded perspective view showing a plasma display panel according to an embodiment of the present invention.

FIG. 1 is a schematic partially exploded perspective view showing a plasma display panel according to one embodiment of the present invention. The invention, however, is not limited to this embodiment.

Figure 2A:
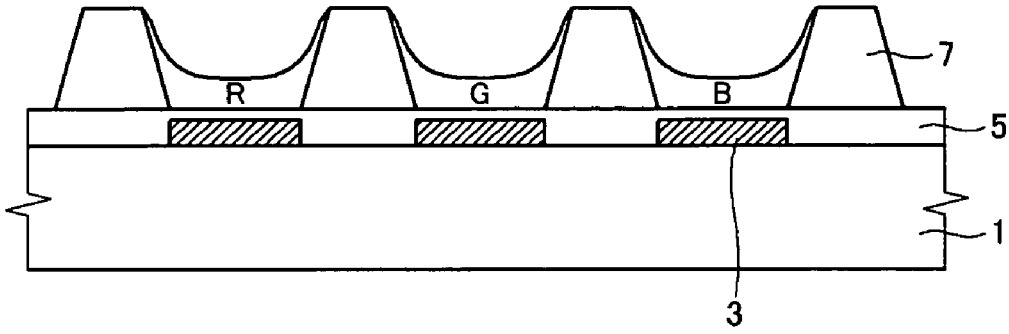
FIG. 2A is a partial cross-sectional view of a rear panel of a plasma display panel that includes a carbon-containing address electrode in accordance with the embodiment shown in FIG. 1.
Figure 2B:
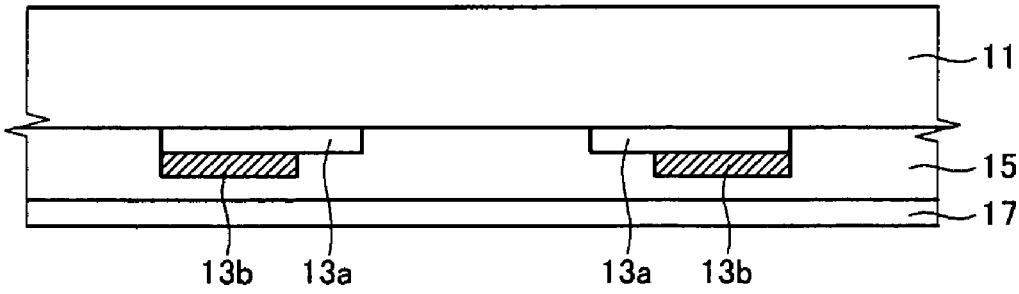
FIG. 2B is a partial cross-sectional view of a front panel of a plasma display panel that includes a carbon-containing bus electrode in accordance with the embodiment shown in FIG. 1.

The plasma display panel in FIGS. 1, 2A, and 2B includes address electrodes 3 formed along one direction (Y direction in the drawing) on a first substrate 1, and a dielectric layer 5 formed on the entire surface of the first substrate 1 and covering the address electrodes 3. Barrier ribs 7 are formed on the dielectric layer 5 between the address electrodes 3, and the barrier ribs 7 are formed as an open or closed type as needed. Red (R), green (G), and blue (B) phosphor layers 9 are disposed between each barrier rib 7.

On one side of a second substrate 11 opposing the first substrate 1, a display electrode 13, which includes a transparent electrode 13*a* and a bus electrode 13*b*, is disposed in a direction perpendicular to the address electrodes 3 (X direction in the drawing). A dielectric layer 15 and a protection layer 17 are formed on the entire surface of the second substrate 11 and covering the display electrode 13. In this way, a discharge cell is formed at the crossed area of the address electrode 3 and the display electrode 13.

In operation, an address voltage (Va) is applied between the address electrode 3 and one of the display electrodes 13 to induce an address discharge, and a sustaining voltage (Vs) is applied between a pair of display electrodes 13 to generate vacuum ultraviolet rays. Then, the vacuum ultraviolet rays generated during a sustain discharge excite a corresponding phosphor layer 9, which emits visible rays through the transparent second substrate 11.

In this embodiment of the present invention, a plasma display panel includes a carbon-containing electrode. The plasma display panel includes the first substrate 1 and the second substrate 11 disposed substantially in parallel and spaced a distance from one another. A plurality of address electrodes 3 are formed on the first substrate 1, and a first dielectric layer 5 is disposed on the entire first substrate 1 so as to cover the address electrodes 3. A plurality of barrier ribs 7 are disposed between the first substrate 1 and the second substrate 11 so as to define compartmentalized discharge cells at intervals. The phosphor layers 9 are formed in the discharge cells.

A plurality of display electrodes 13 are disposed on one side of the second substrate 11 opposing the first substrate 1 in a direction intersecting the address electrodes 3. A second dielectric layer 15 is formed on the entire surface of the second substrate 11 so as to cover the display electrodes 13, and a protection layer 17 is formed to cover the second dielectric layer 15.

At least one electrode selected from the address electrodes 3 or a bus electrode 13*b* includes carbon. The carbon included in the electrode impedes migration of metal ions that are generated during preparation for firing of an electrode, and thus suppresses yellowing of the first and second substrates made of glass and of the dielectric layers, and inhibits corrosion of the electrodes.

In one embodiment, the carbon inhibits reactivity of metal ions such as silver ions ($Ag^+$) which are generated during a firing process by an ionization difference that causes migration of $Ag^+$ ions to the glass substrates or the dielectric layer. Consequently, a Ag colloid formed by ion exchange between silver ions and alkali metals included in a glass substrate and a dielectric layer is inhibited, and therefore yellowing of the glass substrate and the dielectric layer by the silver colloid formation is prevented so that the bright room contrast ratio of a plasma display panel increases.

The carbon substantially prevents oxidation of an electrode, and therefore corrosion such as metal oxide or metal sulfide formation is prevented when the panel is exposed to the air for a long time, resulting in a substantial prevention of inferiority of an electrode pattern and increasing an electrode life-span.

Carbon content in the electrode ranges from 0.1 to 10.0 parts by weight based on 100 parts by weight of a metal material. When the carbon content is less than 0.1 parts by weight, sufficient migration resistance and anti-corrosion may not be obtained in accordance with the carbon addition. When it is more than 10.0 parts by weight, electroconductivity may be reduced, so the electrode may not be used as an electrode.

The metal material used as the electrode may be at least one material selected from the group consisting of silver (Ag), gold (Au), aluminum (Al), copper (Cu), platinum (Pt), rhodium (Rh), chromium (Cr), a platinum-rhodium alloy (Pt—Rh), and a silver-palladium alloy (Ag—Pd). Silver (Ag) is particularly suitable.

Non-limiting examples of the carbon include at least one material selected from carbon black, graphite, acetylene black, SUPER P™ (manufactured by the 3M Company), ketjen black, denka black, activated carbon powder, fullerene, carbon nanotube, carbon nanofiber, carbon nanowire, carbon nano-horn, carbon nanoring, and combinations thereof.

The carbon-containing electrode is prepared by a thick layer method such as screen printing, lift-off, or photolithography, or by a thin layer method such as physical vapor deposition (PVD) including vacuum evaporation, sputtering, ion-plating, chemical vapor deposition (CVD), or plasma enhanced chemical vapor deposition (PECVD).

When preparing an electrode by using the thick layer method, the metal material and the carbon in the form of powders are mixed with a binder and a solvent to form a paste. The paste may further include cross-linking agents, initiators, dispersing agents, plasticizers, viscosity controlling agents, ultraviolet ray absorbents, photosensitive monomers, and sensitizers.

The average particle diameter of the metal material and the carbon may range from 1 μm to 50 μm and 10 nm to 10 μm, respectively, and the shapes may be of granules, spheres, or flakes.

The carbon may be added in a powder state or in a paste state wherein the carbon powders are dispersed in a binder and a solvent.

The binder resin may be a generally used polyacryl-based resin. Examples include polymethyl(meth)acrylate, polyethyl(meth)acrylate, and polybutyl(meth)acrylate; a polystyrene-based resin such as polystyrene and α-methylstyrene; a novolac resin; a polyester resin; and a cellulose-based resin such as hydroxyethyl cellulose, hydroxypropyl cellulose, and ethyl cellulose.

The solvent may be one or a mixture selected from the group consisting of ketones such as diethylketone, methylbutyl ketone, dipropyl ketone, cyclohexanone, and so on; alcohols such as n-pentanol, 4-methyl-2-pentanol, cyclohexanol, diacetone alcohol, and so on; ether-based alcohols such as ethylene glycol monomethyl ether, ethylene glycol monoethyl ether, ethylene glycol monobutyl ether, propylene glycol monomethyl ether, propylene glycol monoethyl ether, and so on; saturated aliphatic monocarboxylate alkyl esters such as n-butyl acetate, amyl acetate, and so on; lactate esters such as ethyl lactate, n-butyl lactate, and so on; and ether-based esters such as methyl cellosolve acetate, ethyl cellosolve acetate, propylene glycol monomethyl ether acetate, ethyl-3-ethoxy propionate, and so on.

An electrode including carbon according to this embodiment of the present invention may be used, for example, as a bus electrode 13*b* of a front panel and an address electrode 3 of a rear panel constituting a plasma display panel.

FIG. 2A is a partial cross-sectional view showing a rear panel of a plasma display panel including carbon-containing address electrodes 3, and FIG. 2B is a partial cross-sectional view showing a front panel of a plasma display panel including a carbon-containing bus electrode 13*b*.

As shown in FIGS. 2A and 2B, the carbon included in the address electrodes 3 or the bus electrode 13*b* of a plasma display panel inhibits electrode corrosion of the above electrodes 3 and 13*b* and prevents yellowing of the first and second substrates 1 and 11 and dielectric layers 5 and 15.

Figure 3A:
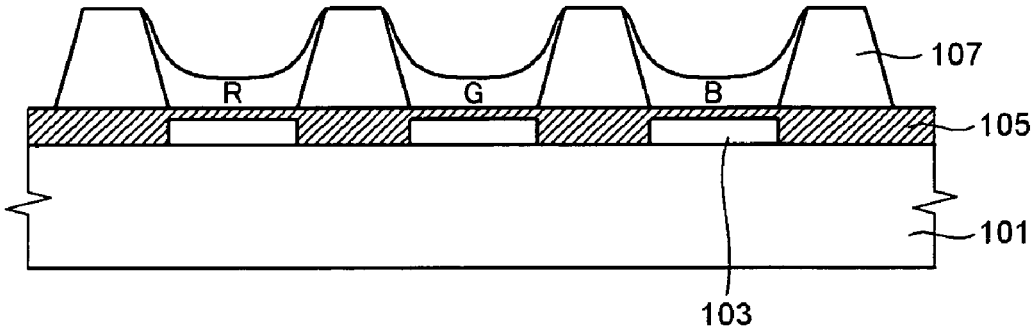
FIG. 3A is a partial cross-sectional view of a rear panel of a plasma display panel that includes a carbon-containing dielectric layer in accordance with an embodiment of the present invention.
Figure 3B:
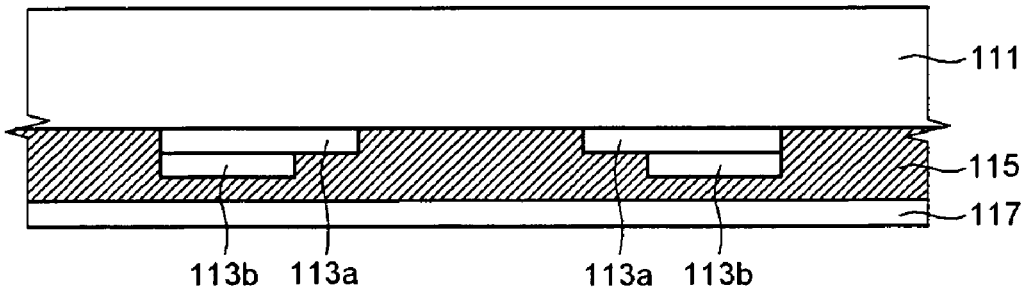
FIG. 3B is a partial cross-sectional view of a front panel of a plasma display panel that includes a carbon-containing dielectric layer in accordance with the embodiment shown in FIG. 3A.

Another embodiment of the present invention, as shown in FIGS. 3A and 3B, provides a plasma display panel in which carbon is included in members neighboring an electrode.

The plasma display panel includes the first substrate 101 and the second substrate 111, which are disposed in parallel and spaced a distance from one another. A plurality of the address electrodes 103 are formed on the first substrate 101, the first dielectric layer 105 is formed to cover the address electrodes 103 on the entire surface of the first substrate 101, and a plurality of substantially parallel barrier ribs 107 are disposed between the first substrate 101 and the second substrate 111 at intervals to form discharge cells. Here, a phosphor layer is formed in the discharge cells.

A plurality of display electrodes 113*a*, 113*b* are disposed on one surface of the second substrate 111 opposing the first substrate 101 in a direction crossing the address electrodes 103. A second dielectric layer 115 is formed over the display electrodes 113*a*, 113*b* and the entire surface of the second substrate 111, and a protection layer 117 is formed to cover the second dielectric layer 115.

Here, at least one of the plasma display panel members includes carbon. In particular, the carbon is included in either the dielectric layer or the first and second substrates. The carbon can suppress the yellowing of the first and second substrates made of glass and the dielectric layer and also inhibit corrosion of the electrodes by impeding the migration of metal ions generated during firing.

In one embodiment, the dielectric layer includes a carbon material that is commonly used for a general dielectric substance, in an amount ranging from 0.1 to 10.0 parts by weight based on 100 parts by weight of a metal oxide. When the amount of carbon is less than 0.1 parts by weight, it is difficult to accomplish migration resistance against metal ions and anti-corrosion, which is expected from the carbon addition. In addition, when the amount of the carbon is more than 10.0 parts by weight, it can cause the dielectric layer to turn black, deteriorating the value of the final panel products.

The invention is not limited to a metal oxide, but can include common oxides used for a dielectric substance. A Pb-free glass powder selected from the group consisting of ZnO, $B_2O_3$, $Al_2O_3$, $SiO_2$, SnO, $P_2O_5$, $Sb_2O_3$, and $Bi_2O_3$ may be used. The metal oxide may be one or more selected from the group consisting of zinc oxide-silicon oxide ($ZnO—SiO_2$), zinc oxide-boron oxide-silicon oxide ($ZnO—B_2O_3—SiO_2$), zinc oxide-boron oxide-silicon oxide -aluminum oxide ($ZnO—B_2O_3—SiO_2—Al_2O_3$), bismuth oxide-boron-oxide-silicon oxide ($Bi_2O_3—SiO_2$), bismuth oxide-boron oxide-silicon oxide ($Bi_2O_3—B_2O_3—SiO_2$), bismuth oxide-boron oxide-silicon oxide ($Bi_2O_3—B_2O_3—SiO_2$), bismuth oxide-boron oxide-silicon oxide-aluminum oxide ($Bi_2O_3—B_2O_3—SiO_2—Al_2O_3$), bismuth oxide-zinc oxide-boron oxide-silicon oxide ($Bi_2O_3—ZnO—B_2O_3—SiO_2$), and bismuth oxide-zinc oxide-boron oxide-silicon oxide-aluminum oxide ($Bi_2O_3—ZnO—B_2O_3—SiO_2—Al_2O_3$) based oxides.

The carbon is similar to that described above, and thus will not be discussed again in more detail.

Next, the carbon-containing dielectric layer is formed in a common thick layer method, such as by a screen printing or a dry film method. Here, in order to use the screen printing or the dry film method, a binder, a solvent, a cross-linking agent, an initiator, a dispersing agent, a plasticizer, a viscosity controlling agent, an ultraviolet ray absorption agent, a photosensitive monomer, and a sensitizer in addition to a metal oxide and carbon may be included, but the present invention is not particularly limited thereto.

According to this embodiment of the present invention, the carbon-containing dielectric layer may be applied to both a front panel and a rear panel forming a plasma display panel. In one embodiment, the dielectric layer formed on the front panel of a plasma display panel is transparent, while the dielectric layer on the rear panel is formed to be white by including $TiO_2$ to reflect light.

FIG. 3A is a partial cross-sectional view showing a rear substrate of a plasma display panel, which includes the carbon-containing dielectric layer 105 in accordance with the second embodiment of the present invention. FIG. 3B is a partial cross-sectional view showing a front substrate of the plasma display panel, which also includes the carbon-containing dielectric layer 115 in accordance with this embodiment of the present invention.

As shown in FIGS. 3A and 3B, the carbon included in the dielectric layers 105 and 115 of a plasma display panel can prevent the corrosion of electrodes 103, 113*a*, and 113*b*, neighboring the dielectric layers 105 and 115 and suppress yellowing of the first and second substrates 101 and 111 as well as the dielectric layers 105 and 115 themselves.

In the embodiments shown in FIGS. 4A-5C, unlike in the previously described embodiments in which carbon is added to an electrode composition or a dielectric composition, the carbon can be formed as a layer neighboring the electrodes to prevent yellowing of a glass substrate and a dielectric layer and to inhibit corrosion of a silver electrode.

These embodiments provide a plasma display panel including the carbon layer between an electrode and a neighboring member.

The plasma display panel includes first and second substrates 201, 301, 401 and 211, 311, 411, respectively, substantially disposed in parallel and spaced a distance from one another. A plurality of address electrodes 203, 303, 403 are formed on the first substrate, and a first dielectric layer 205, 305, 405 is formed to cover the address electrodes and the entire first substrate. A plurality of barrier ribs 207, 307, 407 are disposed between the first and second substrates so as to compartmentalize discharge cells at intervals. Here, phosphor layers are formed in the discharge cells.

A plurality of display electrodes 213*a*, 213*b*, 313*a*, 313*b*, 413*a*, 413*b* are disposed on one side of the second substrate opposing the first substrate in a direction crossing the address electrodes. A second dielectric layer 215, 315, 415 is formed to cover the display electrodes on the entire surface of the second substrate, and a protection layer 217, 317, 417 is formed to cover the second dielectric layer.

Accordingly, the plasma display panel members as described above can be the front or rear panel. The carbon layer formed between them can impede migration of metal ions generated during the firing, and thereby prevent corrosion of electrodes as well as inhibit yellowing of the first and second substrates comprising glass.

In particular, the carbon layer is disposed at at least one position selected from the combinations consisting of the address electrodes on the first substrate and the dielectric layer, the address electrodes and the second substrate, and the second substrate and the dielectric layer. Here, the carbon comprising the carbon layer is as discussed above.

According to these embodiments, the carbon layer may have a pattern corresponding to that of the electrodes, and it can be simultaneously or separately formed with the electrode pattern. For example, a conducting layer is formed on a substrate by sputtering a metal material, and thereafter a carbon layer is formed by sputtering carbon thereon. Then, the carbon layer and the electrode layer are patterned through a general photolithography process.

The carbon layer can be prepared in a thick layer method such as screen printing, lift-off, or photolithography, or in a thin layer method such as physical vapor deposition (PVD) including a thermal deposition, sputtering, ion-plating, chemical vapor deposition (CVD), or plasma enhanced chemical vapor deposition (PECVD).

Here, the thick layer method can make it possible to form the carbon layer with a paste as discussed above. The carbon layer is formed in a thickness of 0.1 μm to 5.0 μm. When the thickness of the carbon layer is less than this range, the carbon layer cannot have the expected effect on a plasma display panel, while if the thickness is greater than this range, the surface of a plasma display panel may turn black, making it difficult to display a picture thereon.

According to these embodiments of the present invention, the carbon layer is formed between an electrode and a plasma display panel member such as a first substrate, a second substrate, and a dielectric layer, which neighbor the electrode.

Figure 4A:
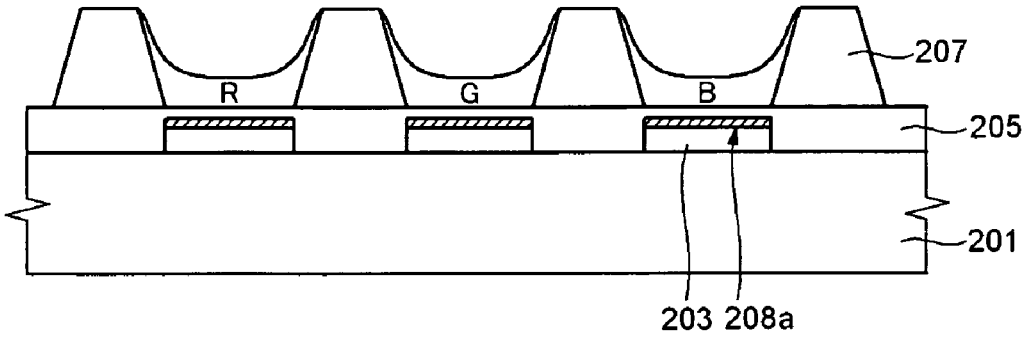
FIG. 4A is a partial cross-sectional view of a rear panel of a plasma display panel that includes a carbon layer between an address electrode and a dielectric layer in accordance with an embodiment of the present invention.
Figure 4B:
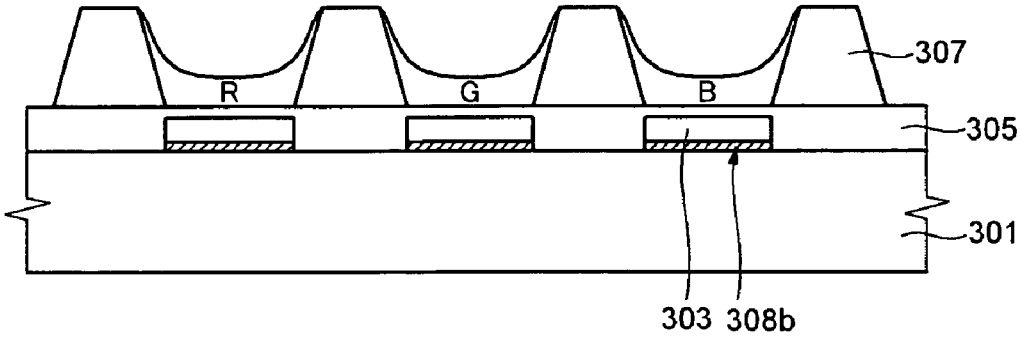
FIG. 4B is a partial cross-sectional view of a rear panel of a plasma display panel that includes a carbon layer between an address electrode and a second substrate in accordance with another embodiment of the present invention.
Figure 4C:
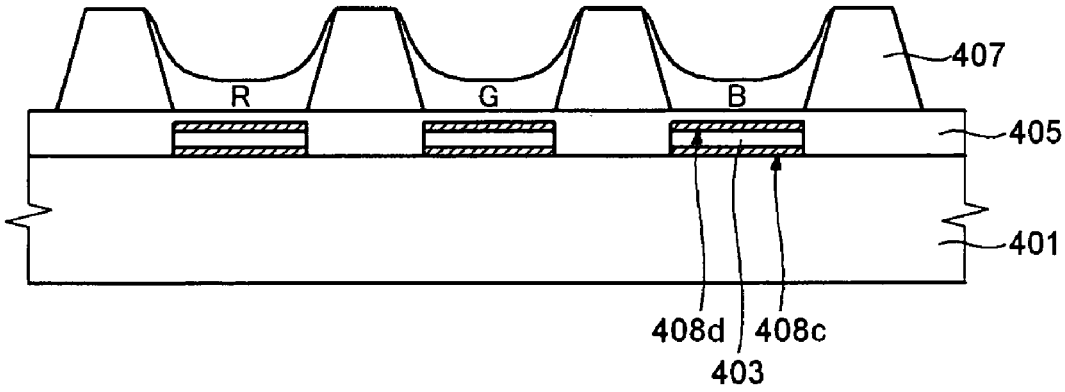
FIG. 4C is a partial cross-sectional view of a rear panel of a plasma display panel that includes a carbon layer between an address electrode and a dielectric layer and between an address electrode and a second substrate in accordance with yet another embodiment of the present invention.

FIG. 4A is a partial cross-sectional view showing a rear panel of a plasma display panel including a carbon layer 208*a* between address electrodes 203 and the dielectric layer 205, FIG. 4B is a partial cross-sectional view showing a rear panel of a plasma display panel including a carbon layer 308*b* between address electrodes 303 and the first substrate 301, and FIG. 4C is a partial cross-sectional view showing a rear panel of a plasma display panel including a carbon layer 408*c* between address electrodes 403 and the dielectric layer 405 and another carbon layer 408*d* between address electrodes 403 and the first substrate 401.

Figure 5A:
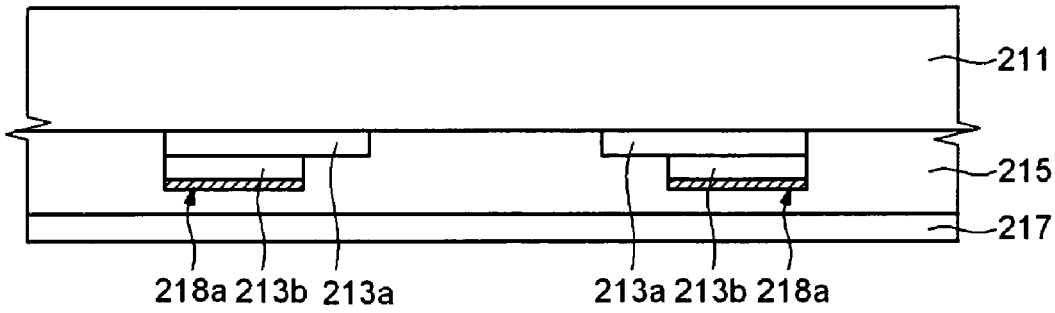
FIG. 5A is a partial cross-sectional view of a front panel of a plasma display panel that includes a carbon layer between a bus electrode and a dielectric layer in accordance with an embodiment of the present invention.
Figure 5B:
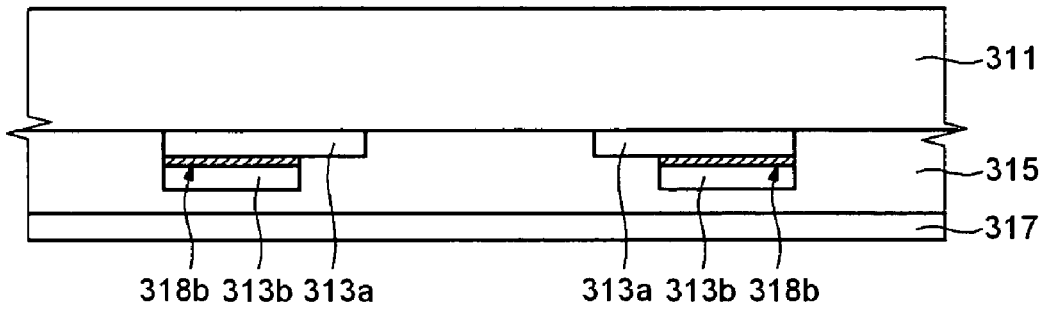
FIG. 5B is a partial cross-sectional view of a front panel of a plasma display panel that includes a carbon layer between a bus electrode and a transparent electrode in accordance with another embodiment of the present invention.
Figure 5C:
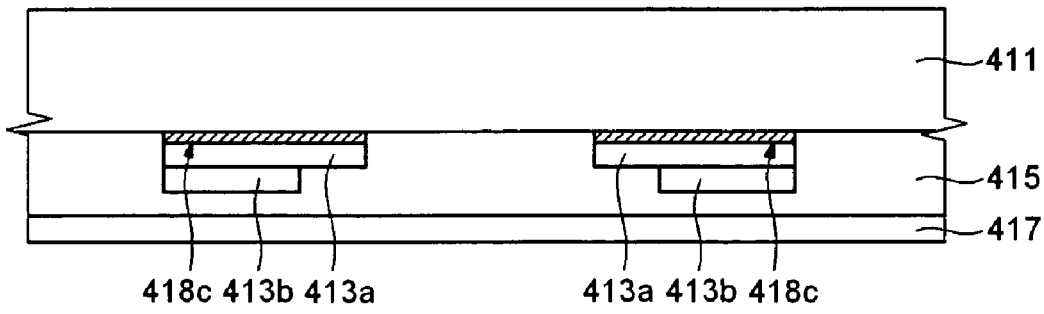
FIG. 5C is a partial cross-sectional view of a rear panel of a plasma display panel that includes a carbon layer between a transparent electrode and a second substrate in accordance with yet another embodiment of the present invention.

In addition, FIG. 5A is a partial cross-sectional view showing a front panel of a plasma display panel including the carbon layer 218*a* formed between a bus electrode 213*b* and the dielectric layer 215 in accordance with an embodiment of the present invention. FIG. 5B is a partial cross-sectional view of a front panel of a plasma display panel that includes a carbon layer 318*b* between a bus electrode 313*b* and a transparent electrode 313*a* and FIG. 5C is a partial cross-sectional view of a front panel of a plasma display panel that includes a carbon layer 418*c* between a transparent electrode 413*a* and a second substrate 411.

As shown in the drawings, the carbon layer can be formed in various structures between an electrode and neighboring panel display members to decrease poor patterning due to electrode corrosion and to inhibit yellowing of a first or second substrate formed of glass and the dielectric layers, and thereby to increase the life-span and reliability of the plasma display panel.

Examples and comparative examples of embodiments of the present invention are illustrated in detail. However, it is understood that the present invention is not limited thereto.

EXAMPLE 1

A 0.5 μm-thick silver electrode was formed by sputtering silver on a glass substrate, and a 0.1 μM-thick carbon layer was formed by sputtering carbon black thereon.

COMPARATIVE EXAMPLE 1

An electrode pattern was formed in the same method as in Example 1, except that a carbon layer was not used.

COMPARATIVE EXAMPLE 2

A 0.5 μm-thick silver electrode was formed by sputtering silver on a glass substrate, and a 0.25 μm-thick carbon layer was formed by sputtering carbon black thereon.

EXPERIMENTAL EXAMPLE 1

Inhibition of Electrode Corrosion

Figure 6A:
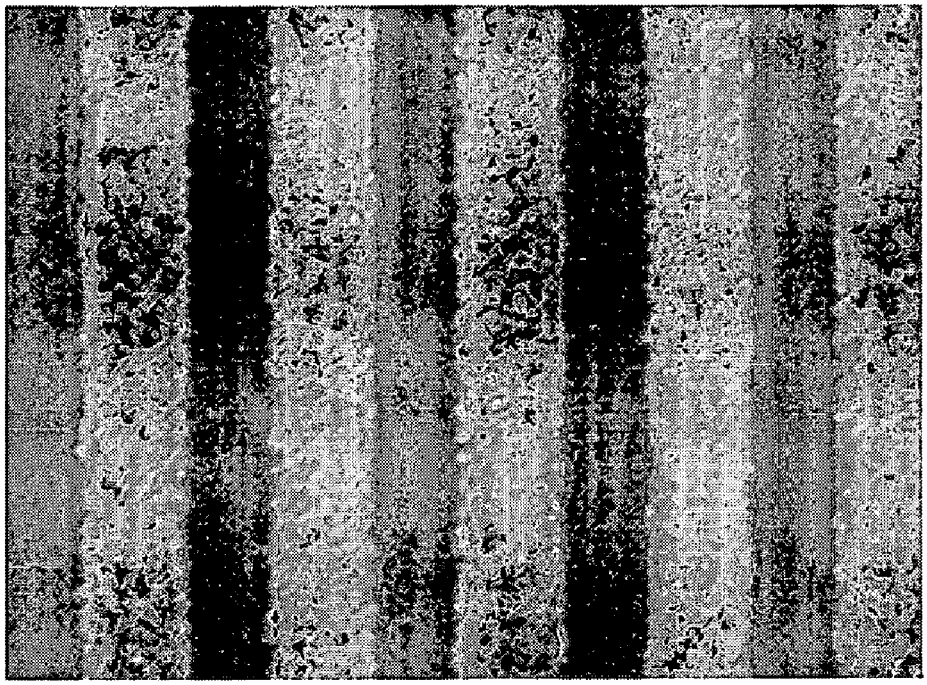
FIG. 6A is an optical microscope photograph showing a silver/carbon electrode according to Example 1.
Figure 6B:
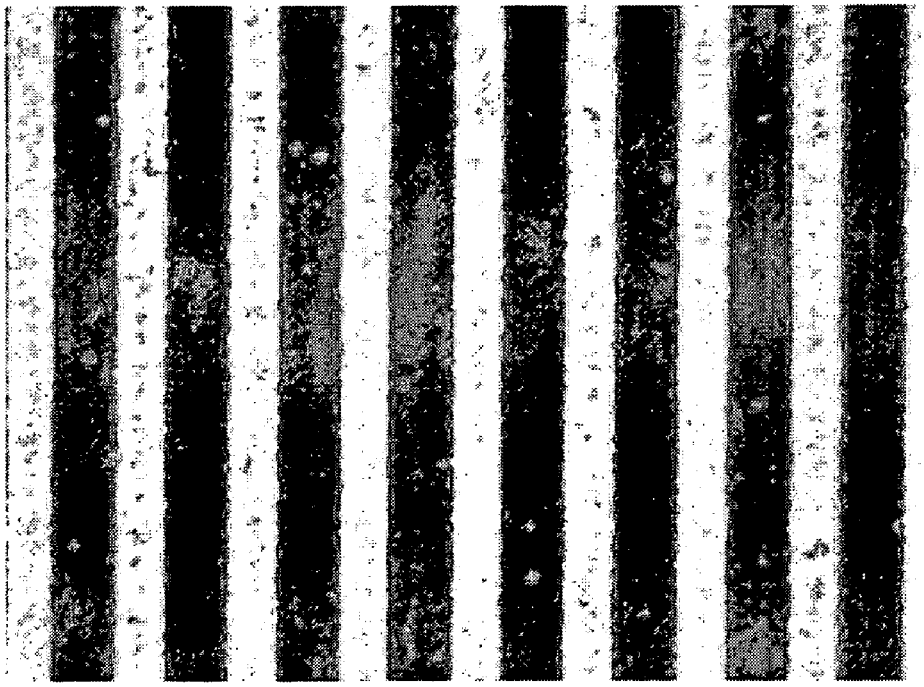
FIG. 6B is an optical microscope photograph showing an electrode according to Comparative Example 1.

Surface photographs of the carbon layers were taken through an optical microscope to measure migration and corrosion degrees of the electrodes fabricated in Example 1 and Comparative Example 1, and the results are provided in FIGS. 6A and 6B.

FIG. 6A shows the surface of the electrode according to Example 1, and FIG. 6B shows the electrode according to Comparative Example 1.

Referring to FIG. 6A, the electrode additionally including a carbon layer did not show a color change, and its terminal also did not show a color change.

In contrast, the electrode in FIG. 6B showed a color change and had surface corrosion, which leads to poor patterning thereof.

EXPERIMENTAL EXAMPLE 2

Electrical Characteristics of an Electrode

Table 1 shows line resistance and bright room contrast ratio of the electrodes fabricated according to Example 1 and Comparative Examples 1 and 2.

TABLE 1

| | Line resistance | Bright room contrast ratio | Color index (b*) |
|---|---|---|---|
| Example 1 | 35 ohm | 105:1 | 0.45221 |
| Comparative Example 1 | 30 ohm | 100:1 | 8.0684 |
| Comparative Example 2 | 38 ohm | 110:1 | 0.74688 |

Referring to Table 1, even though the electrode according to embodiments of the present invention included a carbon layer on the upper part, it had improved electroconductivity because it did not have a color change or corrosion.

It also had an increased bright room contrast ratio, contributing to the fabrication of a plasma display panel with excellent color reproducibility and a clear screen.

EXPERIMENTAL EXAMPLE 3

Suppression of Electrode Yellowing

Figure 7A:
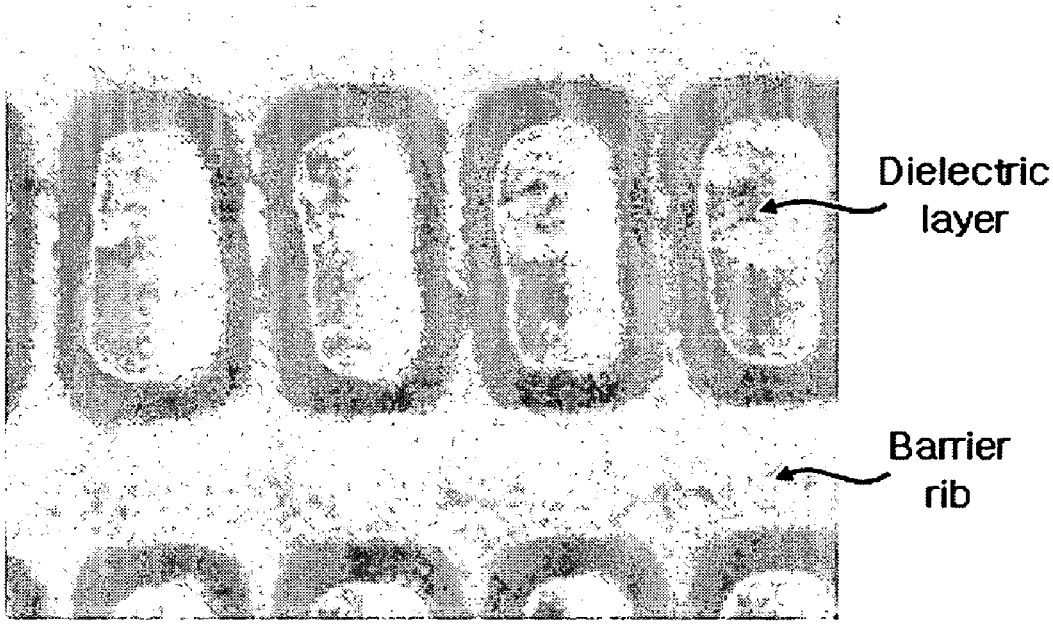
FIG. 7A is an optical microscope photograph showing a silver/carbon electrode according to Example 1.
Figure 7B:
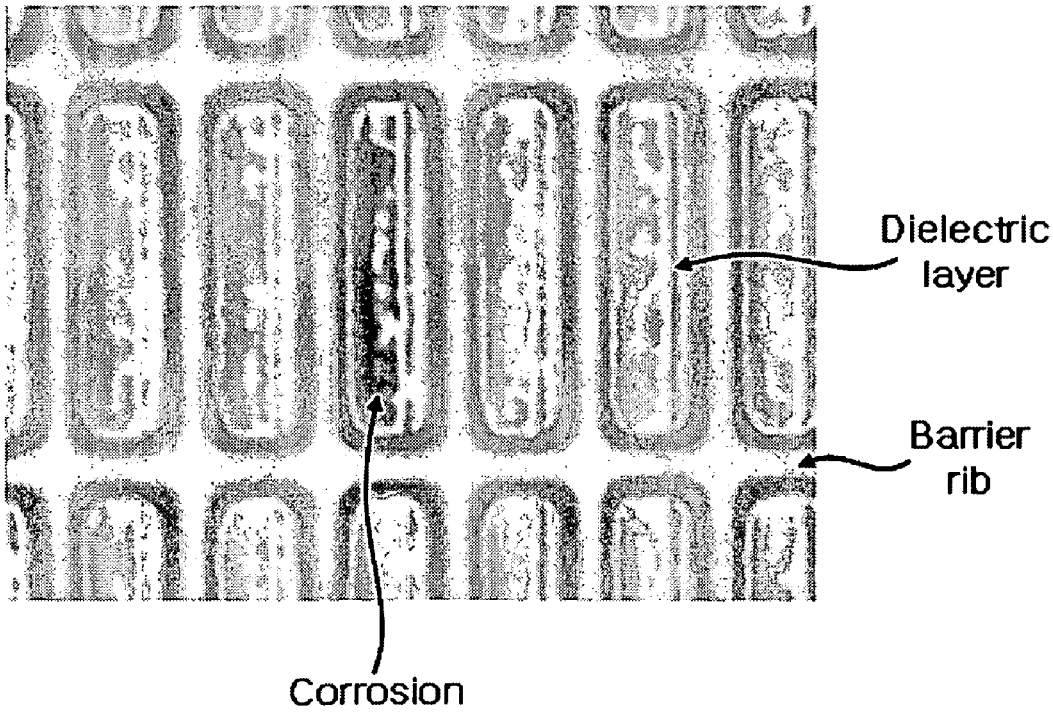
FIG. 7B is an optical microscope photograph showing an electrode according to Comparative Example 1.

The surface photographs of the electrodes in Example 1 and Comparative Example 1 taken with an optical microscope were examined to check yellowing of the electrodes, and the results are provided in FIGS. 7A and 7B.

FIGS. 7A and 7B show a color difference of the electrodes of panels fabricated in Example 1 and Comparative Example 1, respectively.

Referring to FIG. 7A, the carbon layer formed on the silver electrode suppressed corrosion of the electrode, and thereby maintained a white color on the surface thereof. In contrast, referring to FIG. 7B, a part of the electrode was changed to brown due to corrosion. As shown, a conventional problem of yellowing on panels can be suppressed by forming a carbon layer on the surface of an electrode.

EXPERIMENTAL EXAMPLE 4

Electrical Characteristics of an Electrode

Figure 8:
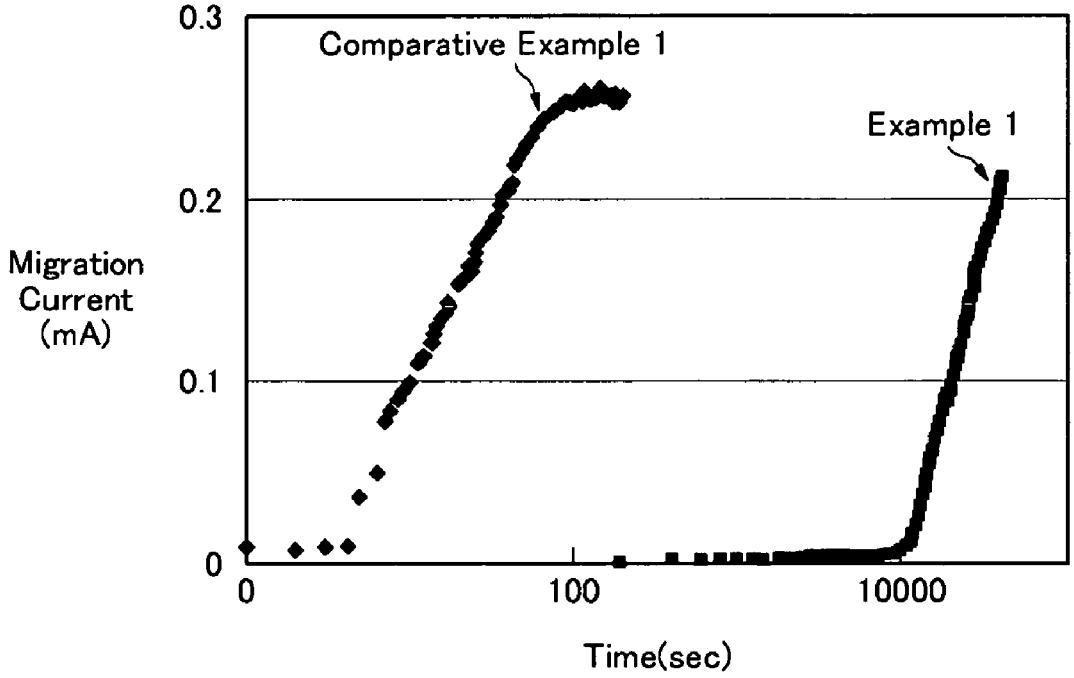
FIG. 8 is a graph showing migration depending on time of electrodes according to Example 1 and Comparative Example 2.

FIG. 8 shows a migration current of electrodes according to Example 1 and Comparative Example 2 with respect to time.

Referring to FIG. 8, silver ions migrate slowly in the electrode including a carbon layer according to embodiments of the present invention. However, the silver electrode migration rapidly progressed in an electrode formed of only silver according to Comparative Example 1, consequently promoting silver colloidization.

As shown, the carbon layer contacting the electrode according to an embodiment of the present invention can effectively intercept silver ion migration in the silver electrode, leading to an increase of life-span of an electrode.

In conclusion, the present invention provides a plasma display panel with improved life-span and reliability by introducing carbon into an electrode thereof or panel members neighboring the electrode, or by forming a carbon layer contacting the electrode, which plays a role of preventing yellowing of a glass substrate and dielectric layers and corrosion of a silver electrode.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims and their equivalents.

What is claimed is:

1. A plasma display panel comprising:

a first substrate and a second substrate disposed substantially in parallel and spaced apart from one another;

address electrodes formed on the first substrate;

a first dielectric layer formed on a surface of the first substrate and covering the address electrodes;

barrier ribs disposed between the first substrate and the second substrate to form compartmentalized discharge cells;

phosphor layers formed in the discharge cells;

display electrodes comprising bus electrodes disposed on one side of the second substrate opposing the first substrate in a direction crossing the address electrodes;

a second dielectric layer formed on a surface of the second substrate and covering the display electrodes; and a protection layer covering the second dielectric layer, wherein at least one electrode selected from the address electrodes or the bus electrodes comprises carbon in an amount ranging from 0.1 to 10.0 parts by weight based on 100 parts by weight of a metal material for corrosion resistance.

2. The plasma display panel of claim 1, wherein the metal material is selected from the group consisting of silver (Ag), gold (Au), aluminum (Al), copper (Cu), platinum (Pt), rhodium (Rh), chromium (Cr), a platinum-rhodium alloy (Pt—Rh), a silver-palladium alloy (Ag—Pd), and combinations thereof.

3. The plasma display panel of claim 1, wherein the carbon is selected from the group consisting of carbon black, graphite, acetylene black, activated carbon powder, fullerene, carbon nanotube, carbon nanofiber, carbon nanowire, carbon nano-horn, carbon nanoring, and combinations thereof.

4. The plasma display panel of claim 1, wherein the carbon has an average particle diameter ranging from 10 nm to 10 μm.

5. The plasma display panel of claim 1, wherein the at least one electrode is prepared in at least one method selected from the group consisting of screen printing, lift-off, photolithography, evaporation, sputtering, ion-plating, chemical vapor deposition (CVD), and plasma enhanced chemical vapor deposition (PECVD).

6. A plasma display panel comprising:

a first substrate and a second substrate disposed substantially in parallel and spaced apart from one another;

address electrodes formed on the first substrate;

a first dielectric layer formed on a surface of the first substrate and covering the address electrodes;

barrier ribs disposed between the first substrate and the second substrate to form compartmentalized discharge cells;

phosphor layers formed in the discharge cells;

display electrodes disposed on one side of the second substrate opposing the first substrate in a direction crossing the address electrodes;

a second dielectric layer formed on a surface of the second substrate and covering the display electrodes; and a protection layer covering the second dielectric layer, wherein at least one dielectric layer selected from the dielectric layer on the first substrate and the second dielectric layer on the second substrate comprises carbon in an amount ranging from 0.1 to 10.0 parts by weight based on 100 parts by weight of a metal oxide for corrosion resistance.

7. The plasma display panel of claim 6, wherein the metal oxide is a Pb-free glass powder selected from the group consisting of ZnO, $B_2O_3$, $Al_2O_3$, $SiO_2$, SnO, $P_2O_5$, $Sb_2O_3$, $Bi_2O_3$, and combinations thereof.

8. The plasma display panel of claim 6, wherein the carbon is selected from the group consisting of carbon black, graphite, acetylene black, activated carbon powder, fullerene, carbon nanotube, carbon nanofiber, carbon nanowire, carbon nano-horn, carbon nanoring, and combinations thereof.

9. The plasma display panel of claim 6, wherein the carbon has an average particle diameter ranging from 10 nm to 10 μm.

10. The plasma display panel of claim 6, wherein the at least one dielectric layer is formed in at least one method selected from the group consisting of screen printing and a dry film method.

11. A plasma display panel comprising:

a first substrate and a second substrate disposed substantially in parallel and spaced apart from one another;

address electrodes formed on the first substrate;

a first dielectric layer formed on a surface of the first substrate and covering the address electrodes;

barrier ribs disposed between the first substrate and the second substrate to form compartmentalized discharge cells;

phosphor layers formed in the discharge cells;

display electrodes disposed on one side of the second substrate opposing the first substrate in a direction crossing the address electrodes;

a second dielectric layer formed on a surface of the second substrate and covering the display electrodes;

a protection layer covering the second dielectric layer; and at least one carbon layer having a thickness of 0.1 μm to 5.0 μm between at least one electrode, selected from the address electrodes or the display electrodes, and a member neighboring the at least one electrode.

12. The plasma display panel of claim 11, wherein the at least one carbon layer is disposed at least one location selected from between the address electrodes and the first dielectric layer, between the address electrodes and the second substrate, or between the second substrate and the second dielectric layer.

13. The plasma display panel of claim 11, wherein the at least one carbon layer has a pattern corresponding to a pattern of the at least one electrode.

14. The plasma display panel of claim 11, wherein the carbon layer is between the address electrode and the member neighboring the address electrode.

15. The plasma display panel of claim 11, wherein the carbon layer is formed in at least one method selected from the group consisting of screen printing, lift-off, photolithography, evaporation, sputtering, ion-plating, chemical vapor deposition (CVD), and plasma enhanced chemical vapor deposition (PECVD).

16. The plasma display panel of claim 11, wherein the at least one carbon layer comprises a carbon material selected from the group consisting of carbon black, graphite, acetylene black, activated carbon powder, fullerene, carbon nanotube, carbon nanofiber, carbon nanowire, carbon nano-horn, carbon nanoring, and combinations thereof.

* * * * *